US005135358A

United States Patent [19]

Myers

[11] Patent Number: 5,135,358

[45] Date of Patent: Aug. 4, 1992

[54] MARINE PROPELLER THEFT DETERRENT SYSTEM

[76] Inventor: James R. Myers, 416 N. Water St., Georgetown, Ohio 45121

[21] Appl. No.: 756,351

[22] Filed: Sep. 9, 1991

[51] Int. Cl.[5] ..... B63H 1/00

[52] U.S. Cl. ..... 416/245 A; 416/244 B

[58] Field of Search ..... 416/244 R, 244 B, 245 R, 416/245 A, 93 A

[56] References Cited

U.S. PATENT DOCUMENTS

| | | | |
|---|---|---|---|
| 3,146,007 | 8/1964 | Boivie et al. | 416/244 R |
| 3,563,670 | 2/1971 | Knuth | 416/93 A |
| 3,703,341 | 11/1972 | Garofalo | 416/245 R |
| 3,732,033 | 5/1973 | Macchi . | |
| 3,981,165 | 9/1976 | Wersinger . | |
| 3,981,617 | 9/1976 | Milewicz . | |
| 4,436,514 | 3/1984 | Takahashi et al. | 416/93 A |
| 4,538,962 | 9/1985 | McCain . | |
| 4,566,855 | 1/1986 | Costabile et al. | 416/93 A |
| 4,605,355 | 8/1986 | Davis et al. | 416/241 A |
| 4,645,422 | 2/1987 | Brushaber . | |

FOREIGN PATENT DOCUMENTS

| | | | |
|---|---|---|---|
| 162212 | 12/1979 | Japan | 416/244 R |

*Primary Examiner*—Edward K. Look
*Assistant Examiner*—James A. Larson
*Attorney, Agent, or Firm*—Charles R. Wilson

[57] ABSTRACT

A marine propeller theft deterrent system is designed for use on a conventional propeller assembly. The system comprises an annular ring component which fits onto an end portion of the propeller's drive shaft and abuts against a hub of the propeller assembly. The annular ring component has an annular groove around an outer periphery of its inside face and a set of upstanding cantilevered springs spaced thereon inside of the annular groove. A rounded cover component has an open end dimensioned to fit over the cantilevered springs and an end wall dimensioned to fit into the annular groove of the annular ring component. When properly positioned, the rounded cover component is in locking engagement with the annular ring component. As such, a retaining nut for the propeller hub is concealed and access to it rendered difficult.

7 Claims, 6 Drawing Sheets

MARINE PROPELLER THEFT DETERRENT SYSTEM

This invention relates to a theft deterrent system for a marine propeller. More particularly, the invention relates to a theft deterrent system which is adapted for ready installation as original equipment or as retrofit equipment on a marine propeller assembly.

Outdoor activities in general are becoming more and more popular as people become more health conscience. Biking and hiking are outdoor activities enjoyed by people of all ages. They are activities which can be undertaken in a city or suburban setting, though are generally enjoyed more in a pastoral setting. People of all socio-economic stratas have long biked and hiked.

More recently, the use of weekend and summer vacation homes has grown in popularity. The home-away-from-home gives the owner a chance to be away from it all. Biking and hiking are very popular with this group of people. Given the fact many of the vacation homes are found near a lake, it is not surprising that boating also is a very popular form of outdoor activity among the vacation home enthusiasts. Boating includes all types of water-craft, including paddle boats, row boats, sail boats, inboard and outboard motor boats and small yachts. The costs and skills involved are very dependent on the type of craft one chooses.

An increasingly alarming problem being experienced by many owners of motorized water-crafts is theft. Whole crafts are sometimes stolen. However, just as annoying is stealing of a part of the craft. Of course, the more expensive a part, the more likely it will be the target of a thief, especially those parts which are easily removed from the craft and are difficult to trace. Boat propellers are one such part. The propellers can be removed from the motor's drive shaft using ordinary tools in a short time. Propellers are fairly expensive and there appears to be a ready market for used propellers. They are difficult to trace and given the fact the costs of doing so cannot be justified, usually the thief goes unpunished.

The problem of marine propeller theft is a known problem and is particularly bothersome to the boat's owner. The cost of replacing the propeller is annoying, but, also the time it takes to locate and purchase a replacement propeller is time that could be better spent on the lake. There have been proposed several different locking mechanisms to deter propeller theft. Examples of such mechanisms are found in U.S. Pat. Nos. 3,732,033, 3,981,617, 3,981,165 4,538,962 and 4,645,422. The known mechanisms all suffer in one way or another. Some are costly. Some are difficult to install and/or operate. Some are easily tampered with or circumvented.

There has now been developed a marine propeller theft deterrent system which is cost effective and readily installed. The system is adapted to fit onto the drive shaft of the boat's motor and work in conjunction with existing equipment. The theft deterrent system finds use in the original equipment market and the retrofit market.

SUMMARY OF THE INVENTION

A marine propeller theft deterrent system is adapted for use on a propeller assembly of a motorized water-craft. The system comprises an annular ring component and a rounded cover component. The annular ring component fits over an end portion of the motor's drive shaft. An outside face of the annular ring component abuts against the propeller assembly's hub. An inside face has an annular groove which extends around the face near an edge thereof. The inside face of the annular ring component also has a set of upstanding cantilevered springs spaced around the inside of the groove. The rounded cover component having an open end is dimensioned so that an edge of the open end fits into the annular groove. The inside wall of the cover component engages the springs of the annular ring component in a locking fashion. The assembled theft deterrent system effectively conceals a retaining nut used to hold the propeller hub onto the drive shaft and effectively prevents access to it.

DETAILED DESCRIPTION OF THE INVENTION

The marine propeller theft deterrent system of the invention is described with reference to the drawings. The essential components of the system as well as their use on a propeller assembly are described in the following paragraphs.

Figure 1:
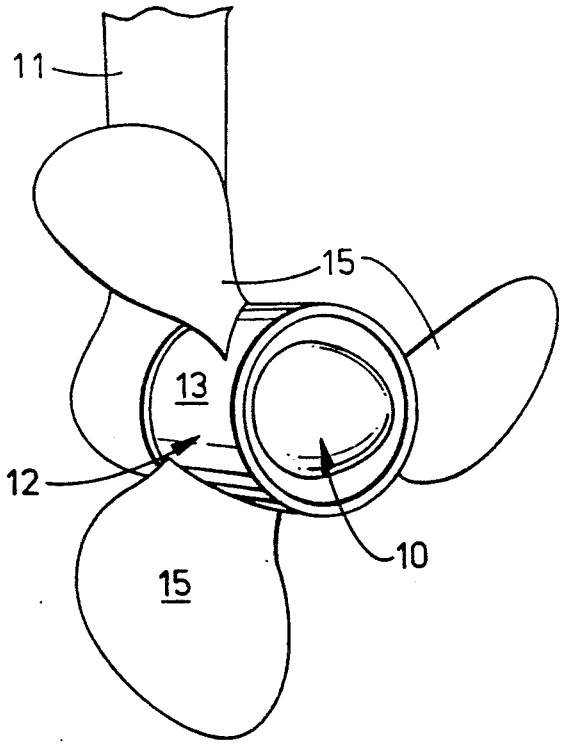
FIG. 1 is a perspective view of a marine propeller assembly showing a partial outdrive for a motor, a set of propeller blades mounted on a propeller hub and the theft deterrent system of this invention.

With reference to FIG. 1, there is shown a partial view in perspective of the theft deterrent system 10 used with an outdrive 11 and a propeller assembly 12. The outdrive 11 is part of a conventional motor used with pleasure water-craft. The motor can be an inboard or outboard motor. To the casual observer, the theft deterrent system 10 appears to be a nose cone often used on propeller assemblies for appearance purposes. However, in fact the theft deterrent system 10 proves to be a formidable obstacle to any would be thief attempting to steal the propeller hub 13 of the propeller assembly 12.

Figure 2:
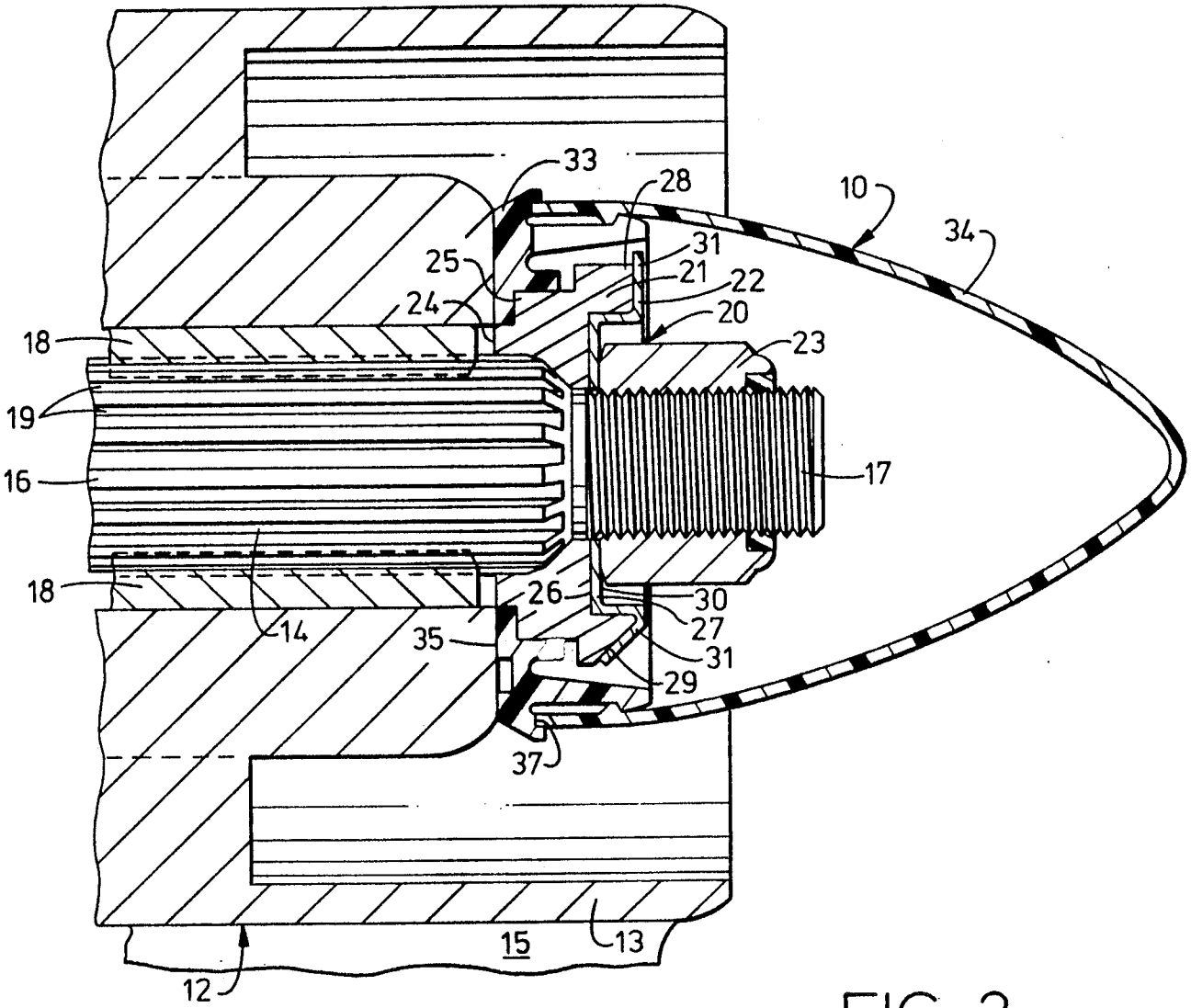
FIG. 2 is an elevational view partially in section showing the theft deterrent system of FIG. 1 in detail as mounted on a drive shaft of the outdrive.

As with all marine motors of the type contemplated herein and with reference to FIG. 2, the motor delivers power through a drive shaft 14 to cause the propeller hub 13 to revolve. A plurality of propeller blades 15 project radially outwardly from the hub 13. The particular size and configuration of the propeller blades are determined by the manufacturer using known criteria including motor horsepower, boat size, etc. The drive shaft 14 has a splined portion 16 near its terminus and a threaded portion 17 at its terminus. The splined portion 16 of the shaft passes through a central passageway of the propeller hub 13 and normally extends beyond the end of the propeller hub so that a portion of it is exposed. A series of axial keys 18 on the central passageway of the hub mate with the recesses 19 of the splined portion of the drive shaft to operatively lock the hub and drive shaft together. As readily apparent, as power is delivered from the motor to the drive shaft to cause it to revolve, the propeller hub is also caused to revolve with the propeller blades consequently revolving to propel the water-craft.

The propeller assembly 12 including the propeller hub 13 is rotatably secured to the drive shaft 14 by means of a retention means 20 comprised of a splined ring coupling 21, a star retainer washer 22 and a retainer nut 23. The splined ring coupling 21 of the propeller assembly retention means is internally keyed to fit over the splined end portion 16 of the drive shaft 14. The splined ring coupling is an annular member dimensioned to fit into locking engagement with the drive shaft such that the drive shaft and the ring coupling always rotate together. The outer face 24 of the splined ring coupling has a diameter which is dimensioned to fit into the central passageway of the propeller hub 13. A shoulder 25 which extends from the annular ring normally fits up against the end of the propeller hub. The inner face 26 of the coupling has a center recess 27 and a series of alternating radial lugs 28 and radial notches 29 around the center recess. The star retainer washer 22 is used in conjunction with the splined ring coupling 21. The star retainer washer has a hexagonal-shaped cupped portion 30. The dimensions of the cupped portion 30 of the star retainer washer and the center recess 27 of the ring coupling are such that the star retainer washer is able to rotate relative to the splined ring coupling. A series of projecting tabs 31 extend radially from the washer and are used to lock the retention means together during use as described below.

The retainer nut 23 also has a hexagonal outer surface configuration such that it fits into the cupped portion 30 of the star retainer washer 22 in a wrenching fashion. As the retaining nut is threaded onto the drive shaft, the star retainer washer rotates until it is seated within the center recess of the splined coupling ring. Continued wrenching of the retaining nut secures the retention means of the propeller assembly. To ensure against inadvertent reverse rotation of the retaining nut, at least one of the projecting tabs 31 on the star retainer washer 22 is bent down into a radial notch 29 of the splined ring coupling 21. The projecting tabs 31 on the star retaining washer and the radial notches 29 on the ring coupling are spaced such that there will always be at least one tab overlying a notch and preferably two or three tabs overlying notches for optimum retention.

Further to the objectives of the invention, the theft deterrent system 10 is intended for positioning on the drive shaft 14 to work in conjunction with the aforedescribed retention means 20 of the propeller assembly 12. As best understood with reference to FIGS. 2 and 3, the theft deterrent system 10 is comprised of an annular ring component 33 and a rounded cover component 34. The two components of the system are cooperatively engaged when mounted on the propeller assembly. The system is mounted in a manner which does not interfere with the basic operation of the motor and its propeller assembly.

The annular ring component 33 of the theft deterrent system 10 is dimensioned to fit over the splined portion 16 of the drive shaft 14 such that a substantially flat outside face 35 thereof abuts against the end of the propeller hub 13. An inside face 36 of the annular ring component 33 has an annular groove 37 around an outer periphery to receive the rounded cover component of the theft deterrent system as described below. The groove's width is approximate the wall thickness of the cover. A center annular recess 38 is dimensioned to receive the shoulder 25 of the splined ring coupling 21.

Figure 5:
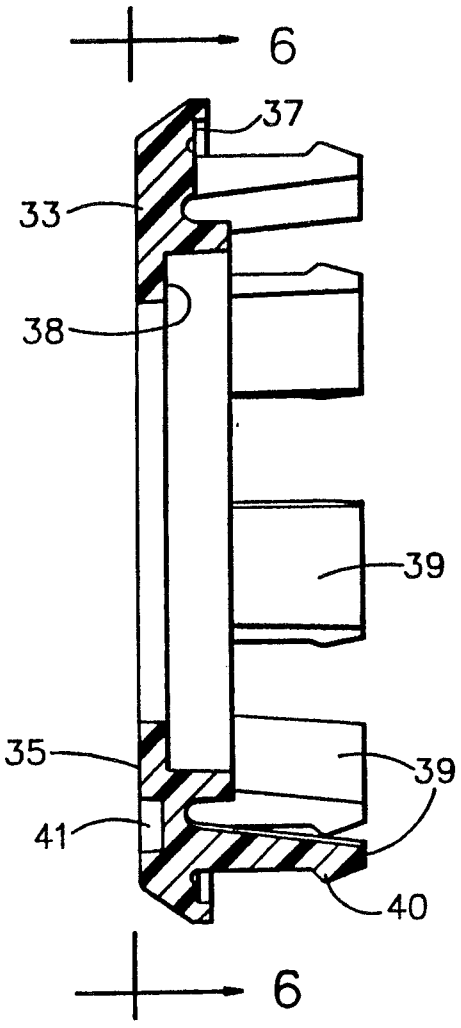
FIG. 5 is a side view in section of the annular ring component of the theft deterrent system taken along line 5—5 of FIG. 4.
Figure 4:
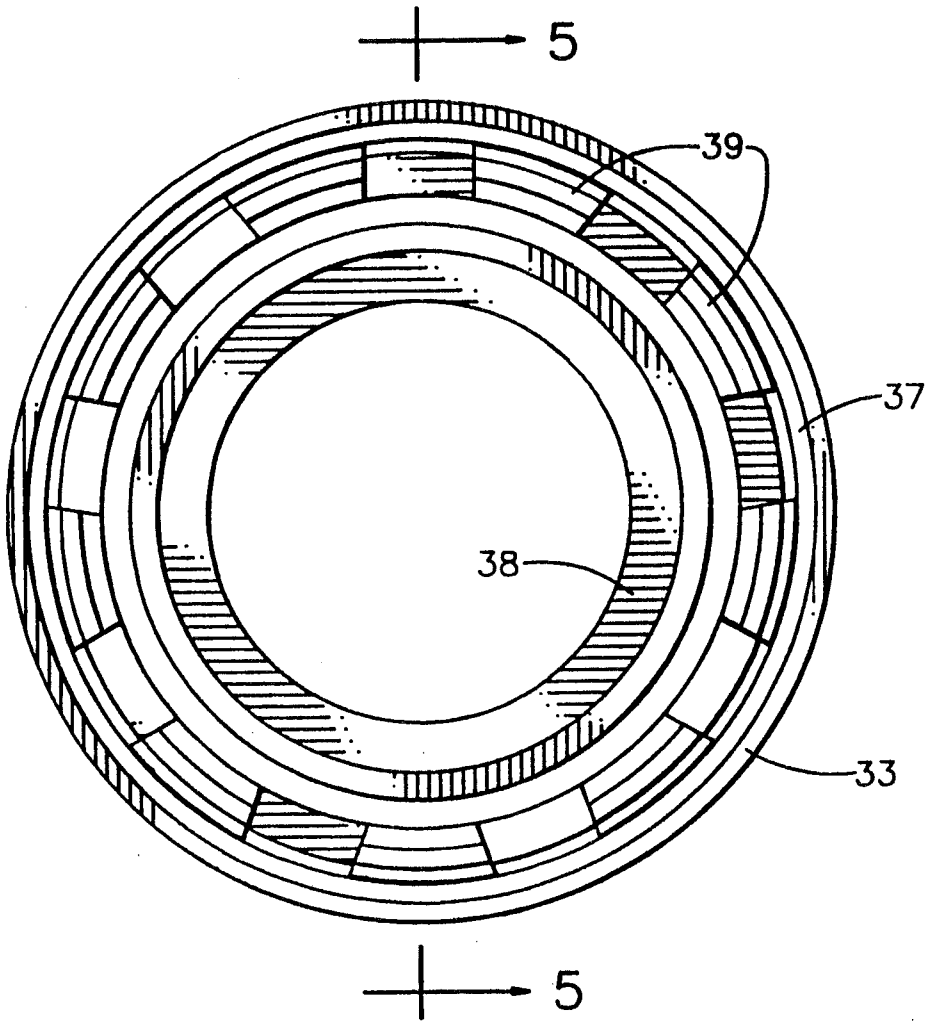
FIG. 4 is a plan view of an inside face of the annular ring component of the theft deterrent system of FIG. 3.

A set of upstanding cantilevered springs 39 are spaced on the annular ring component inside of the annular groove 37. There are from four to twelve, preferably eight to ten of the springs equispaced around the annular groove. The particular number of springs is dependent on the number of lugs placed on the splined ring coupling by its manufacturer. The springs are sufficiently resilient to bend or give when the rounded cover is forced down over them. As evident in FIGS. 2, 3 and 5 each of the cantilevered springs 39 has a barb 40 on an exterior sidewall for locking engagement.

Figure 6:
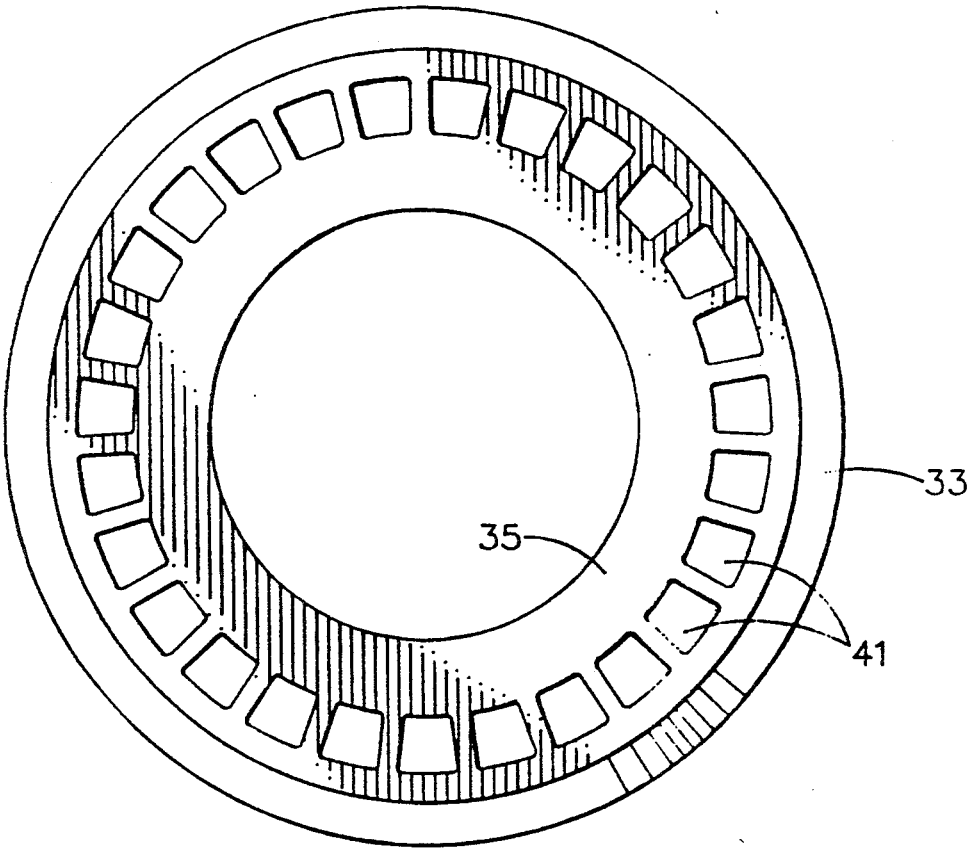
FIG. 6 is a plan view of an outside face of the annular ring component of the theft deterrent system of FIG. 5.

As most evident in FIGS. 2 and 6, a series of shallow cores 41 is spaced around the periphery on the outer face of the annular ring component 33 to aid in its manufacture. Provision for the cores allows the component to be molded without the formation of sink marks and cracks. At the same time, a sacrifice in rigidity is not made.

The annular ring component described above is placed on the drive shaft and held there by the splined ring coupling, star retainer washer and retaining nut. As positioned, it rotates with the drive shaft.

Figure 3:
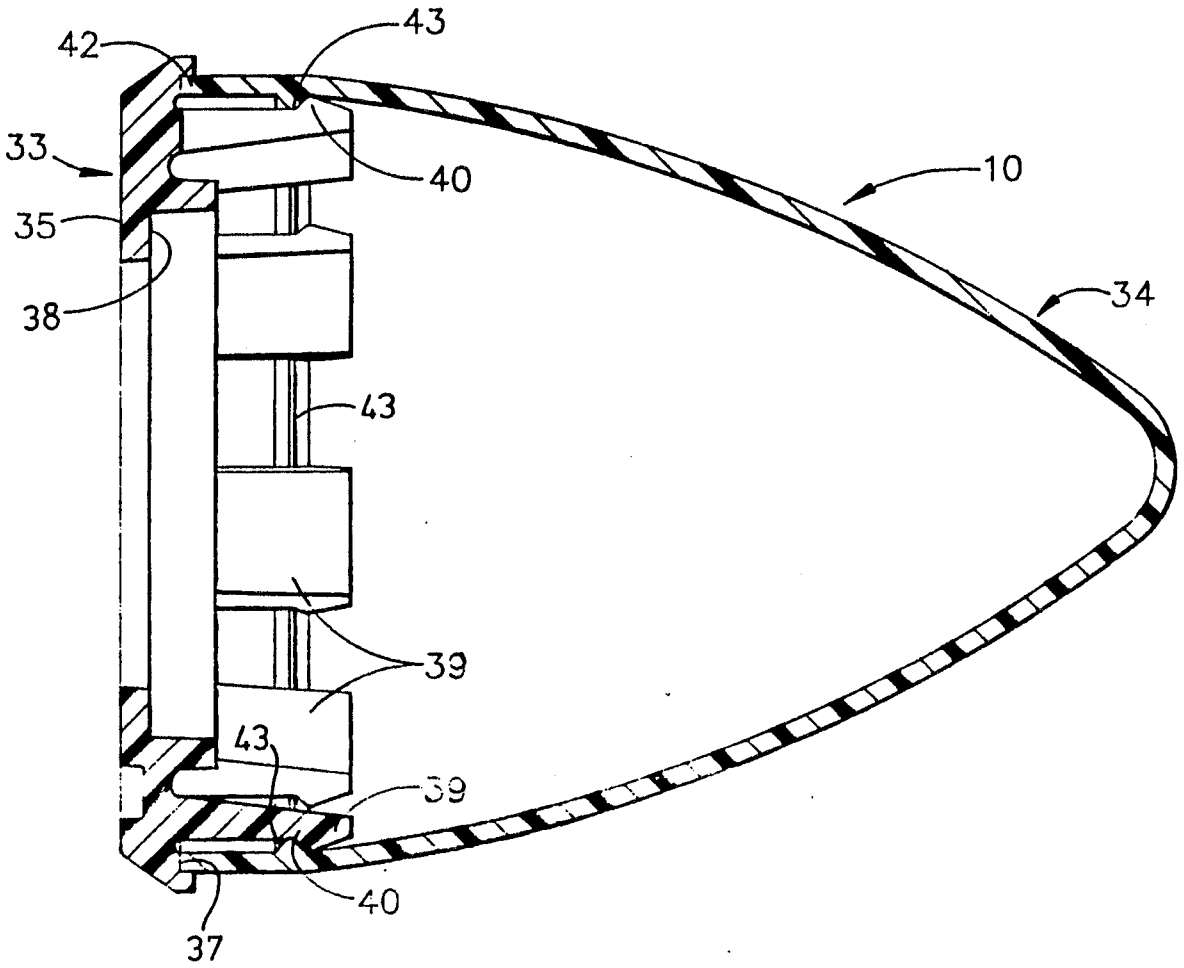
FIG. 3 is a sectional view of the theft deterrent system of the invention prior to installation.

The rounded cover component 14 of the theft deterrent system is open-sided having an end wall 42 diameter and thickness to fit into the annular groove of the annular ring component. Additionally, the cover component has an interior radial ridge 43 near its openside positioned to forcibly engage the barbs 40 on the annular ring component's cantilevered springs when the two components are assembled. FIGS. 2 and 3 show the cover component and the annular ring component assembled and, as evident to the skilled artisan, secured together. The end wall and radial ridge of the cover component are cooperatively engaged to the annular groove and barbs of the annular ring component. However, a sufficient force directed to the cover component will cause it to pivot about an end wall point opposite the point of impact to disengage the cover component from the annular ring component. Most importantly, the cantilevered springs of the annular ring component are not damaged by this means of disengagement.

The rounded cover component depicted in the drawings is bullet-shaped, though other rounded shapes such as spherical, ellipsoidal and conical-shaped are possible. The rounded shape of the cover component is used due to the fact such a shape inherently is difficult to grasp by hand or tool and accordingly deters the would be thief in trying to remove it. The bullet-shaped cover is preferred because of appearance reasons.

Figure 7:
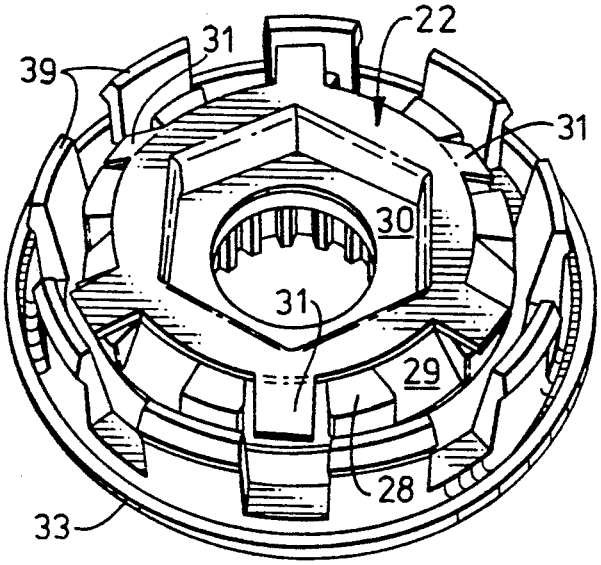
FIG. 7 is a perspective view of the annular ring component of the theft deterrent system of FIG. 2 showing its partial assembly with components of the propeller assembly.
Figure 8:
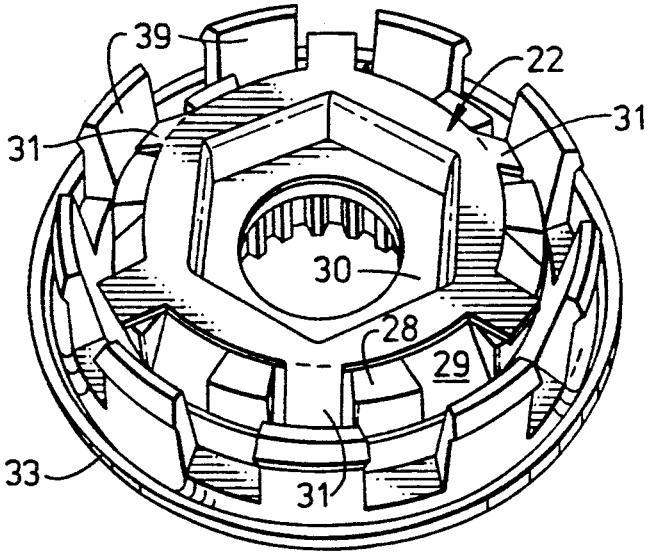
FIG. 8 is another perspective view of the annular ring component of the theft deterrent system of FIG. 2 showing a partial assembly with the components of the propeller assembly in a second working position.

FIGS. 7 and 8 show two modes of using the theft deterrent system of the invention. In the mode depicted in FIG. 7, the open spaces between the cantilevered springs 39 on the annular ring component 33 and those tabs 31 on the star retainer washer 22 which are bent down into the radial notches 29 of the splined ring coupling 21 are caused to be in alignment when the system is initially installed onto the propeller assembly.

This mode of use provides only a limited degree of theft deterrence. The would be thief must determine how to remove the cover component 34 from engagement with the annular ring component. To one knowledgeable with the system, a simple sharp blow by a hammer to a sidewall of the cover component frees the cover component. This feature is advantageous to the owner in that it allows him to readily access his own propeller assembly for removal and maintenance reasons. At the same time, the feature presents an obstacle to the would be thief who is not familiar with the operation of the theft deterrent system. However, once the cover component is removed, the bent tabs 31 are readily straightened with channel lock pliers and the whole propeller assembly disassembled to remove the propeller hub.

The mode of use of the theft deterrent system depicted in FIG. 8 provides a greater degree of theft deterrence than that depicted in FIG. 7 and as described above. In FIG. 8, the cantilevered springs 39 on the annular ring component 33 and those tabs 31 on the star retainer washer 22 which are bent down into the radial notches 29 of the splined ring coupling 21 are caused to be in alignment during initial installation. As such, even if the would be thief is able to free the cover component 34 from the annular ring component 33, he is further deterred in his efforts in that a special tool and an inordinate effort is required to straighten the tabs and disassemble the propeller assembly. In effect, the bent tabs are inaccessible because of their alignment with the cantilevered springs. The would be thief is thus discouraged in his endeavors and likely to look for another target.

The deterrent value of the system of the invention is especially valuable given the fact many propeller hub theft attempts occur while the propeller hub is still in the water. Sufficient force to free the system's cover component from the annular ring component is virtually impossible to achieve underwater. Additionally, even if freed, the use of special tools and techniques underwater is itself very discouraging to the would be thief.

In operation, a water-craft's propeller assembly is initially disassembled by removing the retaining nut, star retainer washer and splined ring coupling from the drive shaft. The annular ring component of the theft deterrent system is slipped onto the drive shaft and then the ring coupling, star retainer washer and retainer nut replaced. When the retainer nut is fully tightened, at least one of the tabs on the star retainer washer is bent into a radial notch on the splined ring coupling. Next, the rounded cover component is forced over the upstanding cantilevered springs on the annular ring component and seated into the component's annular groove. The theft deterrent system is now in place. The cover component's removal to gain access to the propeller hub's retaining nut is readily accomplished by the water-craft owner because of his knowledge of the system; however, to the would be thief who is not familiar with the system, removal of the cover component is difficult and serves its deterrent purpose.

While the theft deterrent system of the invention has been described in detail, it should be understood various modifications can be made. All changes and modifications of an obvious nature are considered within the scope of the appended claims.

I claim:

1. A marine propeller theft deterrent system for use on a propeller assembly having a drive shaft with a threaded end portion on which a propeller hub is mounted and further having a retention means for fitting on the threaded end portion to secure the assembly, said theft deterrent system comprising:

(a) an annular ring component which fits over the threaded end portion of the drive shaft and abuts against the propeller hub and is held in engagement therewith by the retention means, said annular ring component having an annular groove around an outer periphery and a set of upstanding cantilevered springs spaced inside of the annular groove; and (b) a rounded cover component with an open end dimensioned to fit over the upstanding cantilevered springs and an end wall dimensioned to fit into the annular groove of the annular ring component so as to engage the cantilevered springs in a locking fashion to deter access to the retention means of the propeller assembly.

2. The marine propeller theft deterrent system of Claim 1 wherein the cantilevered springs have sufficient resiliency to bend to receive the rounded cover component during installation and to forcibly engage the cover component to deter its unauthorized removal.

3. The marine propeller theft deterrent system of Claim 1 wherein each of the cantilevered springs on the annular ring component has an exterior barb and the rounded cover component has a radial ridge extending around an inside circumference so that when the cover component is seated in the annular groove of the annular ring component the barbs of the cantilevered springs and the radial ridge engage in the locking fashion.

4. The marine propeller theft deterrent system of Claim 3 wherein the annular ring component has from four to twelve of the cantilevered springs.

5. The marine propeller theft deterrent system of Claim 4 wherein the annular ring component has a center opening with a diameter such that a splined ring coupling and a star retainer washer of the retention means are able to cooperatively engage the annular ring component to secure the propeller assembly.

6. The marine propeller theft deterrent system of Claim 5 further wherein the annular ring component has an inner annular recess around its center opening to guide the splined ring coupling of the retention means into engagement.

7. The marine propeller theft deterrent system of Claim 1 wherein the rounded cover component is bullet-shaped.

* * * * *